United States Patent [19]

Risinger

[11] 4,359,094

[45] Nov. 16, 1982

[54] SHEAR RELIEF VALVE

[75] Inventor: Ronald L. Risinger, Dallas, Tex.

[73] Assignee: Otis Engineering Corporation, Dallas, Tex.

[21] Appl. No.: 214,726

[22] Filed: Dec. 9, 1980

[51] Int. Cl.[3] ..... E21B 23/08; E21B 34/08; E21B 43/12

[52] U.S. Cl. ..... 166/317; 166/313; 166/319; 137/70; 137/797

[58] Field of Search ..... 166/317, 319, 316, 323, 166/313; 137/70, 68 R, 67, 797

[56] References Cited

U.S. PATENT DOCUMENTS

| | | | |
|---|---|---|---|
| 2,092,793 | 9/1937 | Abercrombie | 137/70 |
| 2,092,819 | 9/1937 | Tennant | 137/70 |
| 3,363,693 | 1/1968 | Bohlmann, Jr. | 166/319 X |
| 3,381,753 | 5/1968 | Fredd | 166/189 X |
| 3,666,012 | 5/1972 | Sizer et al. | 166/319 |

*Primary Examiner*—Stephen J. Novosad
*Attorney, Agent, or Firm*—H. Mathews Garland

[57] ABSTRACT

A relief valve for use particularly for isolating and for permitting communication between flow passages in a well bore which may include parallel tubing strings connected by an H-Member and a single tubing string and a tubing-casing annulus which communicate through a side-pocket mandrel. The valve has a tubular housing having a lower open end and connected at an upper end with a packing mandrel provided with an annular packing assembly for sealing with a bore wall around the valve, a valve stem telescoping along an upper portion into the housing and extending along a lower end portion from the housing, shear screws between the valve stem and the housing for locking the valve stem at a lower valve-closed position, a plurality of spaced locking flanges along the stem and a lock ring within the housing operable with the flanges for locking the stem at a plurality of second valve open positions, a valve assembly on the lower end of the stem having an external annular seal for engaging a seal surface around the valve assembly at a valve-closed position of the stem and valve assembly, shear means between the valve assembly seal and a core portion of the assembly for emergency release of the seal, and the valve stem being sized in length to engage a stop surface in the housing at a valve open position to limit movement of the valve assembly toward the housing to prevent damage to the valve assembly.

13 Claims, 7 Drawing Figures

SHEAR RELIEF VALVE

This invention relates to well tools for oil and gas wells and more particularly relates to a relief valve for isolating tubing strings in a well bore and permitting communication between the strings when desired.

In the oil and gas industry new techniques and tools have been developed for servicing wells which are particularly inaccessible such as subsea oil and gas wells. Such subsea wells frequently have wellheads located in deep waters, often along the sea bottom. One system of procedures and tools have come to be referred to under the term "pumpdown". Many pumpdown systems involve wellheads located over a wide area serviced from a central location. Such wellheads often communicate with multiple oil and gas producing zones which provide oil and gas production into several separate tubing strings installed in a single well bore. For example, two separate tubing strings may be installed in a single well for the purpose of producing two separate zones penetrated by the well. In addition to the fact that the zones may contain fluids under different pressures and fluids which are not desirably intermixed, legal requirements controlling oil and gas production frequently prohibit the mixing of fluids from separate zones in a single producing string. Further, where such wells are serviced by pumpdown equipment and techniques, the well tools installed in, operated, and retrieved from the wells are hydraulically pumped to and from operating locations in the wells. To establish the necessary flow to and from a well for pumping a well tool to and from the well requires a supply flow passage and a return flow passage between the central station and the well. Where a well is equipped for pumpdown including two tubing strings within the well, the tubing strings may be used separately for production but when employed for pumpdown servicing of the well, one of the tubing strings must serve as the input flow passage while the other of the strings as a return flow passage. To establish such flow passages within the well it is necessary to provide equipment which permits selective communication between the tubing strings within the well bore below the location to and from which the well tools are pumped in and retrieved. Such communication is provided by Otis H-Members of various designs which are pipe or tubing fittings having parallel spaced conductors interconnected by a transverse passage and adapted to be secured in parallel tubing strings in a well. Some designs of the Otis H-Members include structural features such as locking recesses and landing nipple recesses for the location and locking of various types of valves within the H-Member to control the flow between the tubing strings through the transverse flow passage. Such H-Members are illustrated and described in detail in Otis Pumpdown Completion Equipment & Service Catalog No. OEC 5113A published April 1979 by Otis Engineering Corporation, Dallas, Tex.

Among the well tools which have been installed in H-Members in pumpdown well completions, one form of tool used for isolating the tubing strings connected by the H-Member and subsequently communicated when desired has been a shear relief valve or a side-door choke. Such a well tool is initially secured in a closed condition plugging the transverse flow passage in the H-Member between the tubing strings and when communication is desired the pressure is raised to a sufficient level to shear the pin holding the device closed releasing a valve member to move to an open position so that communication is established between the two tubing strings through the H-Member. Two particular problems have been characteristic of the shear relief valves available for use in blocking the crossover passage in an H-Member. The valve has a tendency to reclose in response to at least one direction of fluid circulation through the H-Member. This quite obviously interferes with the pumpdown procedures necessarily involving such fluid flow direction. Additionally the available shear relief valves have had a tendency to be severely damaged over the valve portion of the device upon initial opening which produces substantial shock immediately after the shear pin releases particularly under extremely high pressures. It will be evident that equipment damage and malfunction can be extremely costly in well servicing operations.

It is therefore a particularly important object of the present invention to provide a new and improved well tool.

It is another important object of the invention to provide a new and improved well tool used in pumpdown operations in oil and gas wells.

It is another object of the invention to provide a new and improved form of shear relief valve used for isolating tubing strings in a well bore connected by an H-Member.

It is another object of the invention to provide a new and improved shear relief valve which does not reclose in response to fluid flow after initial opening.

It is another object of the invention to provide a shear relief valve which opens under high pressure conditions without damage to the valve member of the device.

In accordance with the invention there is provided a shear relief valve for a well flow coupling to control fluid flow along a flow passage in the coupling which includes a tubular valve body having means for connection with a locking mandrel and an annular seal for sealing with a seal surface along a bore of the coupling, a valve stem telescoping along one end portion into the body, a valve member on the other free end portion of the valve stem for engagement with a valve seat in the flow coupling to shut off flow in the coupling between connected tubing strings, shear pin means between the valve stem and the body for releasably locking the valve closed, latching structure on the valve stem and in the body adapted to coact for latching the valve open, and the first end portion of the valve stem being engageable with a stop surface within the body to limit movement of the valve member toward the body to prevent damage to the valve member when the valve opens.

The invention together with the foregoing objects and advantages will be better understood from the following detailed description of a preferred embodiment thereof taken in conjunction with the accompanying drawings wherein.

Figure 4A:
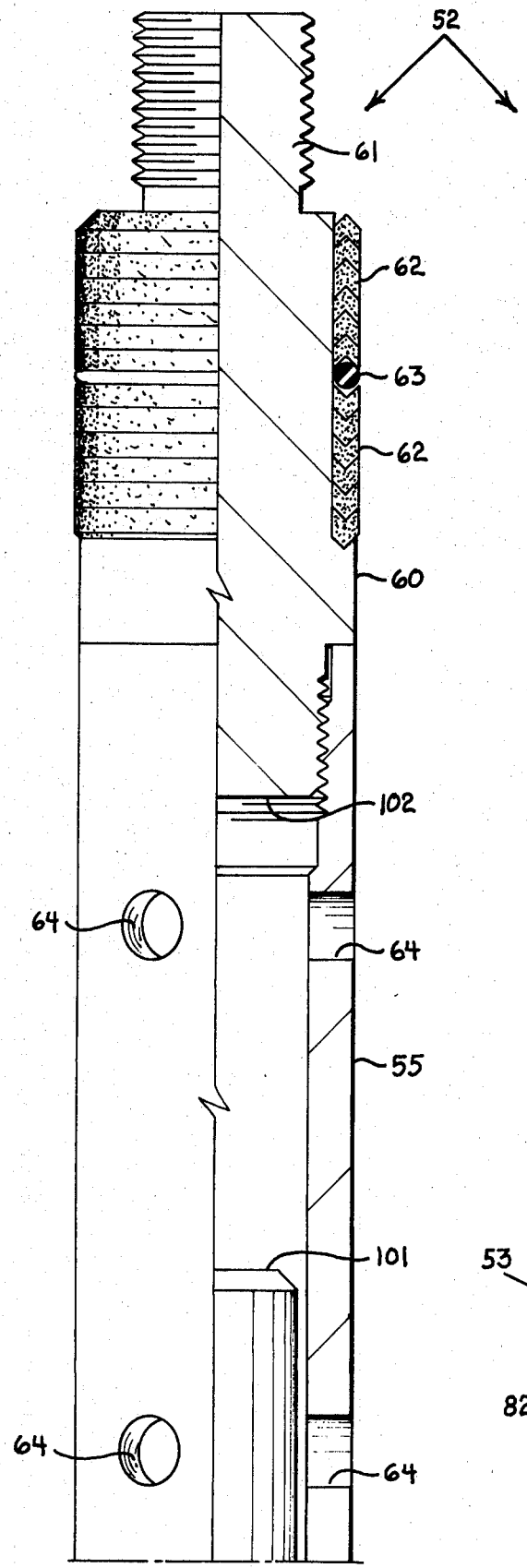
Figure 4B:
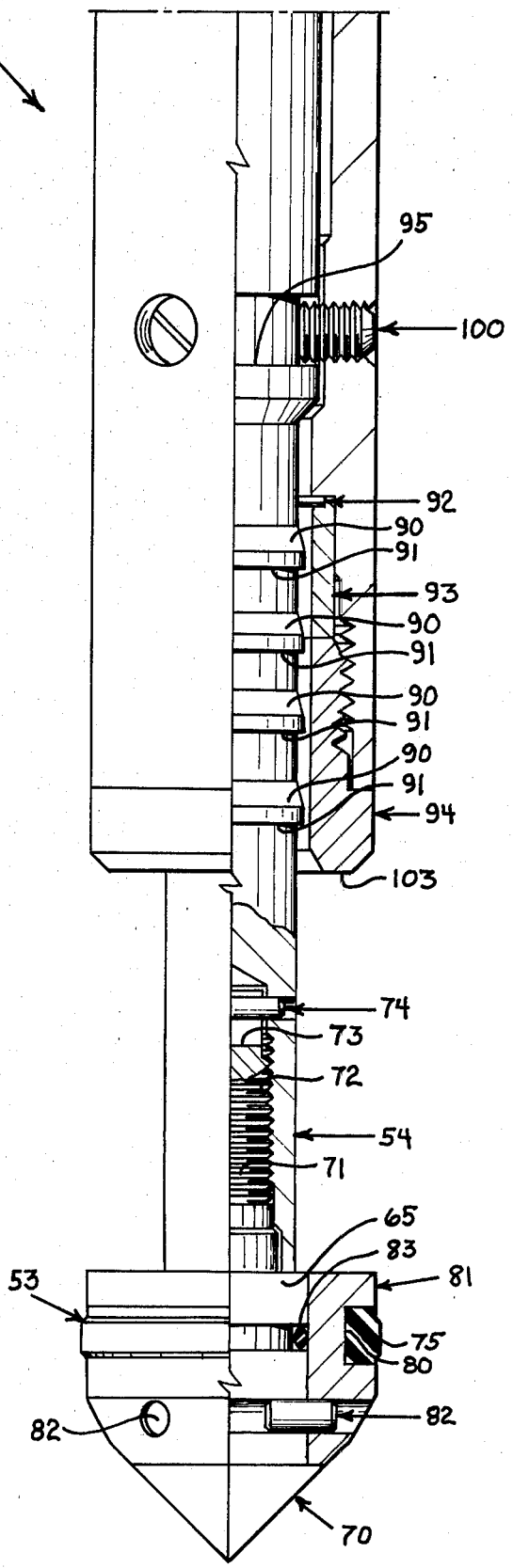
Figure 5A:
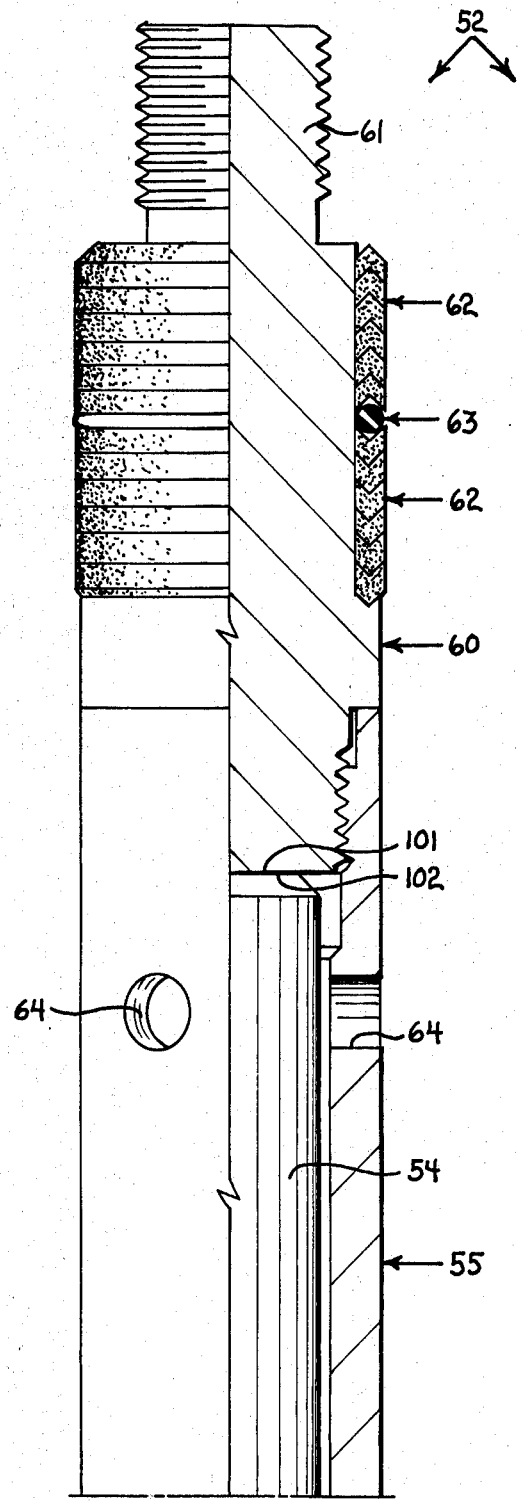
Figure 5B:
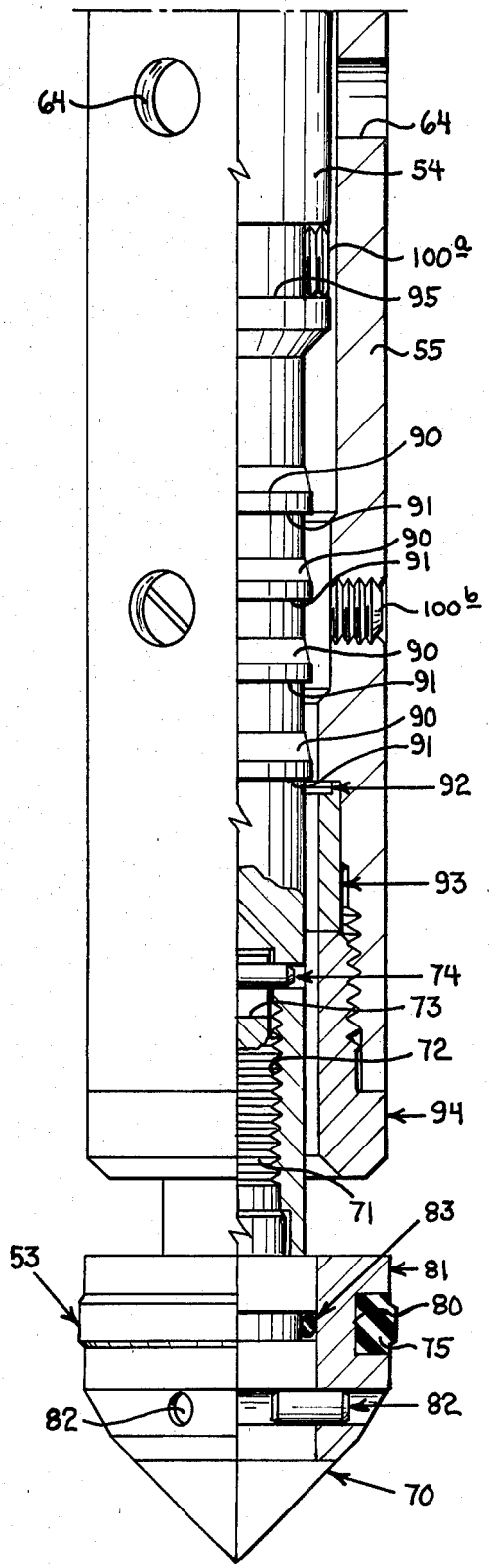

FIGS. 4A and 4B taken together form a longitudinal view in section and elevation of a preferred embodiment of the shear relief valve of the invention, illustrating the valve closed; and FIGS. 5A and 5B taken together form a longitudinal view in section and elevation of the shear relief valve of the invention in open position.

Figure 1:
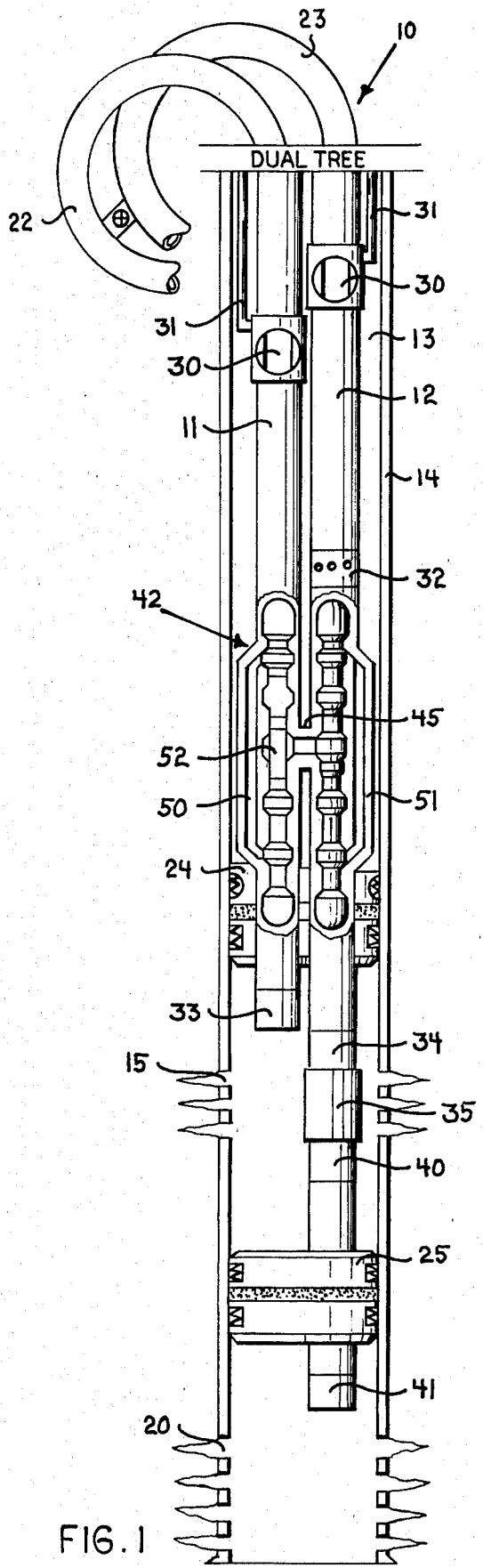
FIG. 1 is a fragmentary schematic longitudinal view in section and elevation of one form of pumpdown well completion system utilizing a shear relief valve in accordance with the invention.
Figure 2:
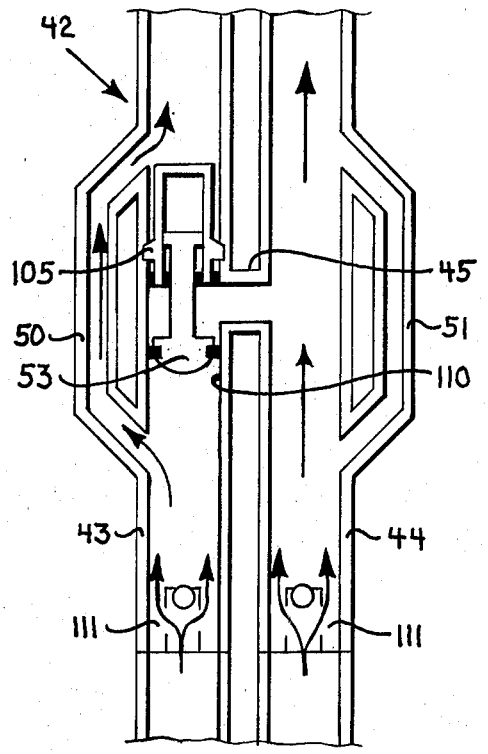
FIG. 2 is an enlarged fragmentary longitudinal schematic view in section of an H-Member used in the well system of FIG. 1 showing a shear relief valve in accordance with the invention in a closed position during simultaneous separate production in the well through two tubing strings connected by by H-Member.
Figure 3:
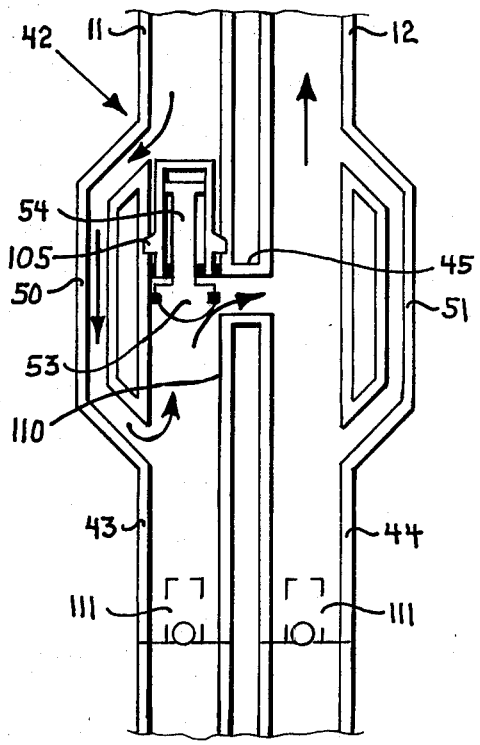
FIG. 3 is a longitudinal fragmentary view in section similar to FIG. 2 showing the shear relief valve of the invention open for fluid circulation between the tubing strings during a pumpdown procedural step.

Referring to FIG. 1, a pumpdown well completion system 10 includes two separate parallel tubing strings 11 and 12 installed in a well bore 13 provided with a casing 14 which is perforated at 15 and 20 permitting flow of well fluids from vertically spaced separate producing formations around the well into the well bore. In a typical offshore ocean bottom well the tubing strings are supported from a wellhead 21 mounted on the ocean bottom and connected by flexible flow lines 22 and 23 with a service facility, not shown, located on a platform on the surface of the water or along the shore. The flow lines 22 and 23 connect through the wellhead 21 with the tubing strings 11 and 12, respectively. The tubing string 11 is connected through an upper packer 24 which seals around the tubing string with the inner wall of the casing 14. The lower end of the tubing string opens below the packer 24 so that well fluids flowing into the well bore through the casing perforations 15 may enter the tubing string 11 below the packer. Similarly the tubing string 12 extends through the packer 24 and through a lower packer 25 terminating below the lower packer for flow of well fluids from the perforations 20 into the lower end of the tubing string 12. Each of the tubing strings is fitted with suitable standard safety devices and other conventional pumpdown well tools for producing and servicing the well. For example, each of the tubing strings includes a tubing-retrievable, ball-type, safety valve 30 each of which is connected with a control line 31 which extends up the well bore to the wellhead and on to the service facility for remote control of the safety valves. The valves are of the type which can be installed and removed through the flexible flow lines 22 and 23. The tubing string 12 includes a sliding side-door valve 32 which is a sleeve type valve adapted to be opened by pumpdown techniques and tools to communicate the annulus in the casing around the tubing string above the packer 24 with the interior of the tubing string 12. The lower end of the tubing string 11 is equipped with a no-go landing nipple 33 which allows the installation of various tools such as a plug in the lower end of the tubing string in the event that it is desired to close off communication with the well bore below the packer 24. Similarly the tubing string 12 is fitted with a selective landing nipple 34, a blast joint 35, a polished nipple 40 above the packer 25 and a no-go landing nipple 41 below below the packer. The blast joint is a special thick walled tubing section of erosion resistant material to resist possible erosion from well fluids, sand, and the like coming in through the perforations 15. The landing nipple and polished nipple permit the installation of well tools such as packing devices for tubing repair in the event of damage along the blast joint area. The tubing strings 11 and 12 are interconnected above the packer 24 by an H-Member 42 which is a special tubing string coupling used in pumpdown completions. The H-Member, illustrated in enlarged schematic detail in FIGS. 2 and 3, includes parallel spaced flow conductor sections 43 and 44 providing full opening bores connecting into the tubing strings 11 and 12, respectively, and interconnected by a transverse crossover member 45 which provides communication between the two bores. The flow conductor section 43 of the H-Member is provided with a bypass 50; similarly the flow conductor section 44 is provided with a bypass 51. Each of the flow conductor sections 43 and 44 is provided with suitable internal locking recesses and seal surfaces for the landing and locking of well tools such as shear relief valves in either of the main bores of the H-Member. When such a relief valve is locked in either of the bores of the H-Member the bypass permits fluid flow around the relief valve. In the well completion system as illustrated in FIGS. 1–3 a shear relief valve 52 embodying the features of the invention is installed in the H-Member along the conduit section 43 preventing communication between the tubing strings 11 and 12 through the H-Member until the shear relief valve is opened. After opening of the shear relief valve circulation in either direction between the tubing strings through the H-Member crossover 45 is accomplished by pumping from the service facility through one of the tubing strings and returning the pumped fluid through the other tubing string. In accordance with the principal feature of the invention the shear relief valve 52 remains latched open during the pumping operations. After servicing of the well is completed by pumpdown procedures, the shear relief valve 52 is removed and replaced with another suitable valve for again isolating the tubing strings to permit production from the separate zones through each of the strings.

Referring to FIGS. 4A and 4B, the preferred form of the shear relief valve 52 includes a nose or valve assembly 53 on a valve stem 54 which telescopes into a cylindrical housing 55 between a lower closed position as illustrated in FIG. 4B and an open position as shown in FIG. 5B. The housing 55 is threaded along an upper end portion to a packing mandrel 60 which has a reduced threaded pin portion 61 for connection with a lock mandrel assembly, not shown. A pair of V-seal assemblies 62 are mounted on a reduced upper end portion of the mandrel 60 on opposite sides of an O-ring 63 for sealing around the mandrel along a cylindrical seal surface within the bore of the H-Member in which the relief valve is installed. The housing 55 is provided with two sets of circumferentially spaced bleed ports 64 to prevent interference with the movement of the valve stem by any fluid entering the housing around the stem. Well fluids are free to flow along the stem within the housing during circulation procedures. The valve assembly 53 includes a core 65 having an enlarged lower end conical nose 70 and an integral upper threaded pin 71 engaged in an internally threaded blind bore 72 in the free end of the valve stem 54. The upper end of the pin 71 on the valve core has an inwardly opening slot 73 which receives a transverse roll pin 74 preventing the valve assembly from accidentally unscrewing from the valve stem. An external annular seal 75 is mounted in an external circumferential recess 80 in an annular seal support member 81 mounted on the valve assembly core 65 above the nose 70. The seal carrier 81 is releasably secured to the valve core 65 by a plurality of shear pins 82 extending through circumferentially spaced holes in the seal carrier 81 into circumferential slot in the core 65. An O-ring seal 83 is mounted in an external annular recess on the valve core 65 within the seal carrier 81 to form a fluid tight seal between the core and the seal carrier. The securing of the seal carrier 81 on the valve core by the shear pins 82 permits emergency valve opening in the event that the valve stem becomes jammed by increasing fluid pressure around the valve assembly sufficient to shear the pins 82 so that the seals 75 with the carrier 81 are forced upwardly off of the valve assembly core to allow flow past the valve nose 70.

Referring to FIG. 4B, in accordance with a principal feature of the invention, the valve stem 54 is provided with a plurality of longitudinally spaced external annular locking flanges 90 each of which has a downwardly facing annular locking shoulder 91. An internal annular locking ring 92 is mounted within the housing 55 held in place by a spacer ring 93 secured by an annular retaining nut 94 threaded into the opened lower end of the housing 55. The locking ring 92 is a Spirolox Ring which is an inwardly biased expandible ring sized to expand and contract as each of the valve stem locking flanges 90 passes through the ring. After one of the locking flanges passes through the ring the ring contracts around the valve stem to a size at which the ring is engageable with the locking shoulder 91 on the locking flange to prevent telescoping or extension of the valve stem from the housing thereby latching the stem to the position in the housing to which the stem has telescoped. Above the locking flanges 90 the valve stem 54 is enlarged in diameter and provided with an external annular locking recess 95 which receives the inward ends of a plurality of circumferentially spaced shear screws 100 threaded through the housing 55 into the locking recess. The shear screws lock the valve stem holding the valve assembly closed until circulation through the H-Member is desired.

In accordance with another particular feature of the invention the valve stem length is sized so that the end face 101 on the inward end of the valve stem is engageable with the end face 102 on the inward end of the packing mandrel 60 stopping the valve assembly 53 at a position spaced apart from the end edge 103 of the retaining nut 94 when the valve is opened as represented in FIG. 5B. The valve assembly 53 is thus protected against damage by preventing the valve assembly from striking the end of the valve housing when the valve is opened.

Preparatory to installing the shear relief valve 52 in a pumpdown well completion, the valve is fitted with a suitable lock mandrel or latch assembly secured on the threaded pin 61 on the upper end of the packing mandrel 60. A variety of locking mandrels may be used depending upon the particular configuration of the H-Member locating and locking recesses as illustrated schematically in FIG. 1. For example, Otis Engineering Corporation Catalog OEC 5113A shows locking mandrels and latch assemblies at pages 17, 19, and 23. Due to the fact that the shear relief valve 52 is initially locked closed by the shear screws 100, the valve is ordinarily installed in the H-Member 42 prior to running the tubing strings 11 and 12 into the well bore. Referring to FIGS. 1 and 2, with the shear relief valve 52 supported on a suitable locking mandrel 105, the valve is installed in the H-Member with the locking mandrel engaging the appropriate locking recess along the bore of the conductor portion 43 of the H-Member as represented schematically in both FIGS. 1 and 2. The valve stem 54 of the shear relief valve 52 is locked by the shear screws 100 at the extended closed position represented in FIG. 4B at which the seal assembly of the valve is within the bore of the conductor portion 43 below the crossover 45. The annular seal 75 on the seal assembly 53 engages a seal surface 110 defined along the bore of the conductor portion 43 below the crossover 45, see FIG. 2. With the valve assembly 53 of the shear relief valve locked closed below the crossover 45 of the H-Member there can be no flow between the crossover member and the bore of the conductor portion 43 and thus the tubing strings 11 and 12 are isolated by the closed shear relief valve. In the particular pumpdown well completion system illustrated in FIGS. 1–3, a standing valve 111 is installed in each of the tubing strings below the H-Member. A standing valve is a standard tubing string valve which is in effect a check valve permitting upward flow while precluding downward flow in the tubing string in which the valve is installed. With the tubing strings 11 and 12 isolated by the closed shear relief valve 52, well production fluids may flow upwardly in each of the tubing strings past the standing valve in each string, as shown in FIG. 2, and, in the instance of the string in which the shear safety valve is installed, H-Member conductor portion 43 in FIG. 2, the production fluids flow around the shear relief valve in the bypass 50.

The well completed with the pumpdown system illustrated in FIG. 1 is operated with the shear relief valve 52 in place closed until well servicing by pumpdown procedures is required. It will be understood that the pumpdown procedures necessitate pumping in one of the tubing strings while returning fluids through the other string which cannot be done with the shear relief valve closed. Thus the shear relief valve must be opened to carry out the pumpdown well servicing procedures. The valve is opened by raising the pressure in the tubing string 11 at the H-Member 42 to a level sufficient to apply an upward force to the valve assembly 53 over the area defined by the line of sealing between the seal 75 and the H-Member seal surface which provides a force sufficient to shear the screws 100. When the screws 100 shear the valve assembly 53 with the valve stem 55 is forced upwardly suddenly moving the valve assembly 53 upwardly from the seal surface 110 along the H-Member conductor 43 to a location which allows communication into the crossover 45 connecting the two main bores of the H-Member. The valve assembly 53 moves upwardly as the valve stem telescopes into the valve housing 55 until the upper end surface 101 on the valve stem strikes the lower end surface 102 in the packing mandrel 60 as shown in FIG. 5A. The shear screws 100 are sheared into inward portions **100*a* which remain in the locking recess 95 of the valve stem and the outward end portions 100*b* which remain in the holes in the valve housing. As the valve stem moves upwardly the locking flanges 90 along the valve stem each move through the latch ring 92 which expands and contracts as each of the flanges passes through the ring. When the valve stem stops the latch ring 92 contracts around the stem below the locking shoulder 91 on the bottom of the nearest locking flange 90 which is represented in FIG. 5B as the lowest of the locking flanges on the stem. In the event that the valve stem and valve assembly should not move all the way to the top, the latch ring will lock the stem by engaging the locking shoulder on one of the other lock flanges along the stem. It will be seen in FIGS. 5A and 5B that when the valve stem and valve assembly are at the maximum retracted position at which the valve is fully open, the valve assembly 53** is still spaced from the lower end of the housing thus fully protecting the valve assembly from striking the housing when the valve suddenly opens.

With the shear relief valve 52 fully opened as represented in FIGS. 3 and 5A and 5B, fluid may flow between the crossover 45 and the main bore of the conductor portion 43 of the H-Member. When fluid circulation is initiated from the servicing facility, the pressure is at a level sufficient to move the standing valves 111 closed as also shown in FIG. 3 so that circulation between the tubing strings may be accomplished past the open shear relief valve as represented in FIG. 3. While FIG. 3 shows circulation in one direction only between tubing strings 11 and 12, it is to be understood that the well may be circulated in either direction depending upon the operations being carried out in each of the tubing strings. In circulating fluid in a direction opposite to that shown in FIG. 3 the fluid flow tends to move the shear relief valve toward a closed position because of the downward flow past the open valve assembly 53. In accordance with the principal feature of the invention, however, the shear relief valve 52 cannot reclose because the latch ring 92 is engaged with one of the locking flanges 90 along the valve stem. The shear relief valve thus remains latched open throughout the pumpdown procedures regardless of the direction of flow through the H-Member between the tubing strings. The pressure in the strings 11 and 12 during the pumpdown procedure is maintained at a sufficient level above the pressures in the strings below the H-Member to keep the standing valves 111 closed as shown in FIG. 3 so that circulation is maintained between the tubing strings through the H-Member crossover 45.

After the necessary pumpdown procedures are completed it is necessary to remove the shear relief valve 52 to again isolate the two tubing strings at the H-Member 42. The shear relief valve cannot be reclosed in place in the H-Member because it is latched open by the engagement of the latch ring 92 with the lock shoulder 91 on one of the locking flanges 90 of the valve stem. The open shear relief valve is retrieved by use of either wireline equipment and procedures or by means of pumpdown equipment and techniques. Both procedures are standard well known methods using available equipment. After removal of the open shear relief valve another suitable valve for isolating the tubing strings is installed in the H-Member.

The shear relief valve 52 includes an emergency release feature which may be used in the event that the valve stem 54 is jammed by foreign matter in the housing or otherwise preventing the stem from moving to a valve open position. Under such circumstances a pressure increase in the H-Member conduit section 43 below the closed valve assembly 53 raised to a sufficient level shears the pins 82 in the valve assembly 53 releasing the annular seal 75 and the annular seal carrier 81 so that the seal and the carrier are forced upwardly from the nose cone 70 along the valve stem to a position at which the seal 75 is disengaged from the seal surface 110 so that flow may occur past the nose cone into the crossover 45.

While the shear relief 52 of the invention has been illustrated and described in terms of the particular pumpdown well completion system shown in FIG. 1 utilizing a bypass type of H-Member as represented in FIGS. 1–3, it is to be understood that the shear relief valve is equally useful in a number of other different well completion configurations and flow conductor couplings. For example, the valve may be used in an H-Member having a side pocket for the valve not utilizing bypasses. The operation of the valve, installation, and retrieval are identical to that previously described, the valve being installed in a side-pocket spaced from and connected with one of the main bores of the H-Member rather than being installed along one of the main bores. Further, the shear relief valve may be used in a side-pocket landing nipple employed in a single tubing string in a well bore where a flow pattern for pumpdown is established between the tubing string and the casing-tubing annulus. In such an installation the valve is installed and retrieved and functions as previously described.

What is claimed is:

1. A shear relief valve comprising: a housing; means for connecting said housing with a locking mandrel; a valve stem supported in said housing for movement between a first extended and a second retracted position and having one end portion projecting from said housing; a valve on said one end portion of said valve stem for sealing engagement with a seal surface along a flow passage; means for releasably locking said valve stem at said first extended position; and means for latching said valve stem at said retracted position.

2. A shear relief valve in accordance with claim 1 wherein said valve includes an annular seal.

3. A shear relief valve in accordance with claim 2 wherein said annular seal is secured with said valve by emergency release means operable responsive to fluid pressure against said valve in excess of a predetermined value.

4. A shear relief valve in accordance with claim 3 wherein said means for latching said stem at said retracted position comprises a latch ring in said housing and at least one latch flange on said stem engageable by said latch ring.

5. A shear relief valve in accordance with claim 4 wherein said stem includes a plurality of longitudinally spaced locking flanges for engagement by said latch ring for latching said stem at a plurality of retracted positions in said housing.

6. A shear relief valve in accordance with claim 5 wherein said means for latching said valve stem at said extended position comprises shear screw means between said housing and said stem.

7. A shear relief valve in accordance with claim 6 wherein said emergency release means on said valve includes an annular seal carrier supporting said seal on said valve and shear pin means between said carrier and a core portion of said valve for releasing said carrier responsive to a predetermined fluid pressure applied to said valve.

8. A shear relief valve in accordance with claim 7 wherein the inward end of said stem engages a stop surface in said housing at an open retracted position of said valve stem preventing a damaging engagement of said valve with said housing.

9. A shear relief valve in accordance with claim 8 including a packing mandrel secured with a head end of said housing and an annular seal assembly on said packing mandrel for sealing with a seal surface around said valve housing when said valve is installed in a fluid flow fitting.

10. A shear relief valve comprising: a tubular housing open at a first end; a cylindrical packing mandrel secured with the second opposite end of said housing and provided with a threaded pin portion for connecting said relief valve with a lock mandrel; an annular packing assembly on said packing mandrel for sealing around said mandrel with a tubular seal surface of a fluid flow fitting which said shear relief valve is installed; a valve stem telescoped at a first end into said open end of said housing and extending along a second end portion from said housing, said valve stem being mounted in said housing for retracted movement toward said housing to a valve open position and extended movement away from said housing to a valve closed position; a valve mounted on said second end of said valve stem; an annular seal mounted on said valve for engaging a seal surface in said fluid flow fitting at said extended valve closed position of said stem; emergency release means on said valve supporting said annular seal for release of said seal from said valve responsive to a predetermined fluid pressure to permit fluid flow along said valve at said extended valve closed position of said stem; shear pin means between said housing and said stem releasably locking said stem at said first extended valve closed position; and latch means operably associated with said housing and said stem for latching said stem at a retracted valve open position.

11. A shear relief valve in accordance with claim 10 wherein said latch means comprises a plurality of annular longitudinally spaced latching flanges on said stem and a latch ring secured in said housing engageable with each of said latch flanges on said stem for latching said stem at a plurality of retracted positions in said housing.

12. A shear relief valve in accordance with claim 11 wherein said stem has an inward end face engageable with a stop surface on an inward end of said packing mandrel limiting retracted movement of said stem to a position at which said valve is spaced from said second open end of said housing.

13. A shear relief valve in accordance with claim 12 wherein said annular seal on said valve is mounted on an annular seal carrier and said carrier is secured on a core portion of said valve by shear pins for releasing said carrier to move to a position along said stem to permit fluid flow past said valve when said stem and said valve are at said extended valve closed position.

* * * * *